US005161513A

United States Patent [19]

Feldinger

[11] Patent Number: 5,161,513

[45] Date of Patent: Nov. 10, 1992

[54] DEVICE FOR DAMPING THE INTAKE NOISE OF DIESEL ENGINES

[75] Inventor: Martin Feldinger, Königstein/Ts, Fed. Rep. of Germany

[73] Assignee: VDO Adolf Schindling AG, Frankfurt am Main, Fed. Rep. of Germany

[21] Appl. No.: 663,580

[22] Filed: Mar. 1, 1991

[30] Foreign Application Priority Data

Apr. 30, 1990 [DE] Fed. Rep. of Germany ..... 4013848

[51] Int. Cl.[5] ..... F02M 29/00

[52] U.S. Cl. ..... 123/590; 55/276; 181/229

[58] Field of Search ..... 123/590, 52 M; 55/276; 181/215, 216, 229

[56] References Cited

U.S. PATENT DOCUMENTS

| | | | |
|---|---|---|---|
| 2,881,860 | 4/1959 | Ternes | 55/276 |
| 2,897,916 | 8/1959 | Probst | 55/276 |
| 2,954,096 | 9/1960 | McMullen | 55/276 |
| 3,355,863 | 12/1967 | Pittsley | 55/276 |
| 4,179,883 | 12/1979 | Nishiyama et al. | 55/276 |
| 4,450,933 | 5/1984 | Fukuoka et al. | 181/229 |
| 4,930,472 | 6/1990 | Ozaki | 55/276 |
| 4,934,343 | 6/1990 | Lee | 181/229 |
| 5,016,728 | 5/1991 | Zulawski | 181/229 |

FOREIGN PATENT DOCUMENTS

| | | | |
|---|---|---|---|
| 3429633 | 2/1986 | Fed. Rep. of Germany | 55/276 |

*Primary Examiner*—David A. Okonsky
*Attorney, Agent, or Firm*—Martin A. Farber

[57] ABSTRACT

A device for damping the intake noise in internal combustion engines employs the air intake path (1,5,6) of the diesel engine within which path there is arranged a convergent-divergent nozzle (4) wherein cross section of passage is adjustable by means of a throttle member (3) which can be displaced as a function of a loading of the engine.

11 Claims, 1 Drawing Sheet

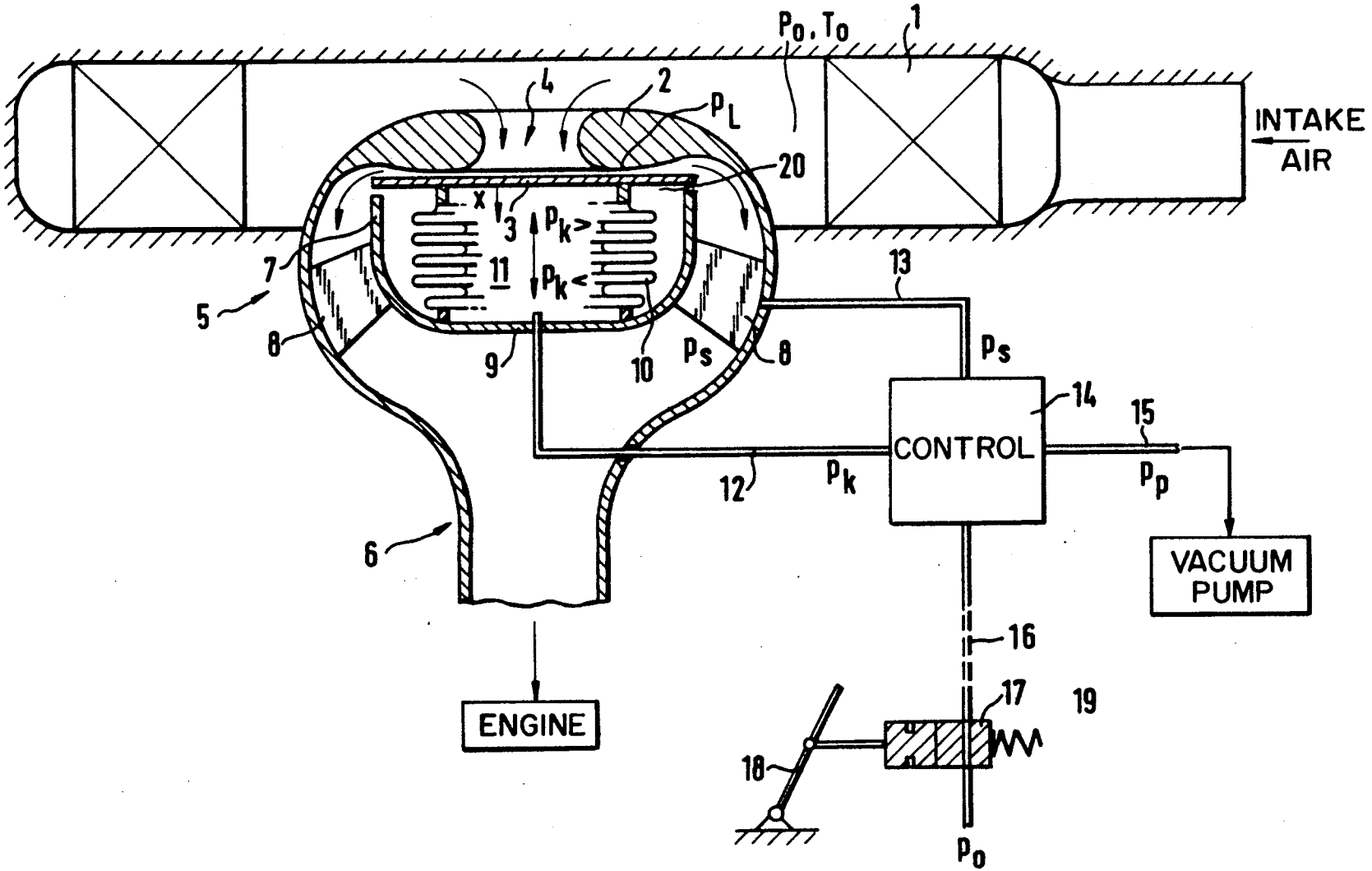
INTAKE AIR
VACUUM PUMP
CONTROL
ENGINE
$P_o, T_o$
$P_L$
$P_s$
$P_k$
$P_p$
$P_o$
$P_k>$
$P_k<$
x
1
2
3
4
5
6
7
8
9
10
11
12
13
14
15
16
17
18
19
20

DEVICE FOR DAMPING THE INTAKE NOISE OF DIESEL ENGINES

FIELD AND BACKGROUND OF THE INVENTION

The present invention relates to a system for damping the intake noise of diesel engines.

The intake noise resulting from pressure pulsations in the air intake path is particularly unpleasant upon the idling of internal combustion engines and the operation thereof under partial load. The intake noise is dominated by other sources of noise when operating under full load. Due to the lack of a throttle valve in diesel engines and the invariable sound-radiating cross section in the air intake path, the intake noise is very great. In order to dampen the intake noise, external noise mufflers are frequently used which, aside from the additional expense, require considerable space.

It is an object of the present invention to create a device by which the intake noise of diesel engines can be effectively damped over a wide operating range by simple structural means.

SUMMARY OF THE INVENTION

According to the invention, the system for damping the intake noise in internal combustion engines has, within an air intake path (1,5,6) of the diesel engine, a convergent-divergent nozzle (4) the passage cross section of which can be adjusted by means of a throttle member (3) which can be displaced as a function of the load. The adjustment of the nozzle passage cross section is to be so effected in this connection that an optimizing of the engine operation with respect to the opposed variables of effected fuel consumption $b_e$ and noise of the internal combustion engine is accomplished. Thus, a reduction in the cross section of passage of the nozzle, while it leads to a reduction in the sound-radiating cross sections and thus to a reduction in noise, results, however, in an increase in the effective consumption of fuel. Of particular advantage in this connection is the damping of noise by means of a convergent-divergent nozzle which provides assurance that with a relatively small nozzle passage cross section, no substantial burbling and eddying of the flow takes place and, thus, atomization of good quality is obtained upon a following injection of fuel. In contradistinction to this, a simple throttle valve will result in an enlarged cross section of passage due to the higher pressure losses, with reduced damping of the noise as a result thereof.

One advantageous further development of the invention provides that the throttle body (3) together substantially with a folding bellows (10) forms a chamber (11) the volume of which is adjustable depending on the chamber pressure. A controller (14) is provided which moves the throttle member (3) by a regulated pressure $p_k$ within the chamber (11) into such a position that the air pressure $p_s$ in the intake pipe (5, 6) is less by up to 100 mbar and preferably by about 60 mbar than the ambient pressure $p_o$. By the regulation of the chamber pressure, the throttle member in the nozzle body is displaced and thus the cross section of passage of the nozzle changed in such a manner that, with high chamber pressure, a smaller cross section of passage is set resulting in a low intake-pipe pressure $p_s$. A low chamber pressure $p_k$ leads to a large cross section of passage and an increased intake-pipe pressure $p_s$. A relatively lower intake-pipe pressure leads, as a result of the high pressure gradient and thus of the high velocity of flow, to increased damping of the intake noise or, due to the smaller sound-radiating cross section, to a relatively high damping of the intake noise. In the case of a relatively less reduced intake-pipe pressure there is also still a damping of the intake noise, the damping, however, being less.

The invention thus makes use of the fact that in diesel engines the cross section of passage in the intake path can be reduced over a wide range of loads without resulting in a large loss in volumetric efficiency and in an effective fuel consumption for the combustion. The reduction in the damping, however, represents an improvement over known devices for the damping of the intake noise in internal combustion engines since there is the possibility, with the device of the invention, to adjust the cross section of passage in accordance with the air requirement of the internal combustion engine so that there is present at all times only such a cross section of passage of the nozzle as is required for optimal combustion with good and effective fuel consumption. Under full load, finally, the cross section of passage of the nozzle is maximum, in which case then however the undampened intake noise recedes into the background, for example, because the travel noises can be louder in a traveling vehicle than the intake noise of the diesel engine.

The chamber pressure $p_k$ should advantageously be produced by means of a servo pressure $p_p$ of a vacuum pump. The vacuum can be provided conveniently, in particular, by the vacuum pump present in diesel passenger cars which serves for the actuating of the brakes.

In the full-load range of the diesel engine, the adjustment of the throttle member (3) is disconnected so that, as described above, the throttle member (3) in its state of switching provides a maximum cross section of passage of the nozzle (4).

A special structural development provides that the nozzle is developed as radial nozzle (4) and the throttle member a throttle plate (3).

The latter is preferably guided displaceably in front of a housing (7) which encircles the intake path and is arranged downstream in the intake pipe (5, 6) of the intake path (1, 5). A bellows (10) is arranged between the bottom (9) of the housing (7) and the throttle plate (3), a pressure line (12) being furthermore provided from the controller (14) to the chamber (11).

According to a further feature of the invention, the housing (7) is provided with a stop (20) for the throttle plate (3) against which stop the plate rests upon maximum cross section of passage of the nozzle (4).

In order to improve the damping of the intake noise, an air filter surrounding the radial nozzle should, furthermore, be provided.

Still further according to the invention, there is also provided a device for measuring the mass of intake air in the manner that the position of the throttle member (3) is detected by means of a position indicator (x).

There is furthermore the possibility of combining the means for damping the intake noise with means for controlling the exhaust-gas return in such a manner that the position of the throttle member as well as the pressure $p_o$ and the air temperature $T_o$ in front of the nozzle are detected. These values are a measure of the amount of residual gas to be mixed to the fresh air drawn in upon a return of the exhaust gas.

BRIEF DESCRIPTION OF THE DRAWING

With the above and other objects and advantages in view, the present invention will become more clearly understood in connection with the detailed description of a preferred embodiment, when considered with the accompanying drawing, the sole figure of which is a diagram of the apparatus of the invention for damping the intake noise of a diesel engine, the apparatus being operative with a device for controlling a return of the exhaust gas.

DETAILED DESCRIPTION OF THE PREFERRED EMBODIMENT

In the embodiment shown in the drawing, an ordinary air filter 1 surrounds a nozzle body 4 which, together with a throttle member developed as throttle plate 3, forms a convergent-divergent radial nozzle 4. The latter debouches via a widened region 5 of the intake path into the intake pipe 6 proper. In the widened region 5 downstream of the throttle plate 3, there is located a housing 7 which is covered by the plate 3 and encircled by intake air flow. A plurality of radially extending arms 8 connect the housing 7 to an outer wall of the widened region 5 and thus establish a defined position of the housing 7 in the widened region 5. To the bottom 9 of the housing 7, there is connected one end of a bellows 10, the other end of which is connected to the housing side of the throttle plate 3. Due to the inherent stability of the bellows 10, the throttle plate 3 is guided displaceable relative to the housing so that in a withdrawn position, and thus with a large cross section of passage, the plate 3 rests in the narrowest region of the nozzle flush on the outside against the housing 7 which acts as stop. In the extended position of the plate 3, the plate 3 provides small cross section of passage, and protrudes with respect to the housing 7.

The figure shows diagrammatically that an air control line 12 leads to the chamber 11 formed between the bellows 10, the bottom 9 of the housing 7 and the throttle plate 3, and another air control line 13 leads to the widened region 5 of the intake path at the level of the arms 8. Both control lines 12 and 13 are connected to a controller 14 which is connected to a vacuum pump by another air control line 15. A final air control line 16 which is connected to the controller 14 cooperates with a two-way valve 17 which can be placed at ambient pressure $p_o$. The two-way valve 17 is controlled by a gas pedal 18 operating against the force of a spring 19 so that, upon idle/partial-load operation, the air control line 16 is at ambient pressure $p_o$, while under full load the air control line 16 is blocked.

The apparatus described above forms part of a diesel engine, the vacuum pump of which, which is ordinarily used to actuate the brakes of a vehicle, supplies a vacuum $p_p$ of about 400 mbar referred to the ambient pressure $p_o$. In the device of the invention for the damping of the intake noise, the pressure $p_s$ in the widened region 5 of the intake path, which is referred to below simply as the suction pipe pressure, is so controlled that it is about 100 mbar and preferably about 60 mbar less than the ambient pressure $p_o$. This is effected via the controller 14 in the manner that a chamber pressure leads with a relatively slight reduction in pressure, as compared with $p_o$, to a relatively large volume in the chamber 11 and thus to a small narrowest cross section of passage of the nozzle 4. A chamber pressure $p_k$ which is relatively greatly reduced as compared with $p_o$ leads to an increase of the narrowest cross section of passage of the nozzle 4. If, finally, the air control line 16 is interrupted in the full load range by means of the two-way valve 17, then only the low servo pressure $p_p$ is present on the controller 14 and it thus produces a low chamber pressure in the chamber 11 so that a maximum narrowest cross section of passage is established in the nozzle 4.

Specific details of the measurement members not essential for practice of the invention have not been shown in detail in the figure. The pressures can be detected by ordinary measurement members. The detection of the position x of the throttle plate 3 for the controlling of the exhaust-gas return can be effected by means of a potentiometer. The potentiometer value can be attained via the housing and one of the arms 8 outwards to an electronic device, the same being true for attaining the pressure $p_k$ via the air control line 12 to the controller 14. The detection of pressure $p_o$ and temperature $T_o$ should be effected between air filter 1 and nozzle 4.

I claim:

1. A system for damping the intake noise of diesel engines, the engine having an intake-air path, the system comprising;

a convergent-divergent nozzle located in the intake-air path; and a throttle member which is displaceable in the nozzle as a function of a loading of the engine for adjusting a passage cross section of the nozzle.

2. A system according to claim 1, further comprising a folding bellows operative with said throttle member to form a chamber the volume of which is adjustable depending on pressure in the chamber;

an intake pipe connecting the nozzle to the engine; and a controller which moves the throttle member by a regulated pressure $p_k$ within the chamber into such a position that the air pressure $p_s$ in the intake pipe is less by up to 100 mbar than the ambient pressure $p_o$.

3. A system according to claim 2, wherein the air pressure $p_s$ in the intake pipe is less by up to 60 mbar than the ambient $p_o$.

4. A system according to claim 2, wherein the engine has a vacuum pump; and the chamber pressure $p_k$ is produced by means of a servo pressure $p_p$ of a vacuum pump.

5. A system according to claim 4, wherein in the full-load range of the diesel engine, adjustment of the throttle member is terminated by the controller so that the throttle member in a state of switching provides a maximum cross section of passage of the nozzle.

6. A system according to claim 3, wherein in the full-load range of the diesel engine, adjustment of the throttle member is terminated by the controller so that the throttle member in a state of switching provides a maximum cross section of passage of the nozzle.

7. A system according to claim 2, wherein the nozzle is a radial nozzle, and the throttle member is a throttle plate.

8. A system according to claim 7, further comprising a housing which encircles intake air flow; and wherein the throttle plate is guided by displacement in front of the housing, the housing being arranged downstream in the intake pipe of the intake path; and the bellows is located between a bottom of the housing and the throttle plate, there being a pressure line provided from the controller to the chamber.

9. A system according to claim 8, wherein the housing is provided with a stop for the throttle plate, against which stop the plate rests upon maximum cross section of passage of the nozzle.

10. A system according to claim 8, further comprising an air filter surrounding the radial nozzle, wherein the air filter passes intake air directed radially inwardly through the filter.

11. A system according to claim 10, further comprising a position indicator; and wherein measurement of the mass of intake air is accomplished by detecting the position of the throttle member by means of a position indicator.

* * * * *